United States Patent [19]

Hauck

[11] Patent Number: 4,752,139

[45] Date of Patent: Jun. 21, 1988

[54] PRECONDITIONING APPARATUS FOR EXTRUDER

[75] Inventor: Bobbie W. Hauck, Sabetha, Kans.

[73] Assignee: Wenger Manufacturing, Inc., Sabetha, Kans.

[21] Appl. No.: 918,099

[22] Filed: Oct. 14, 1986

[51] Int. Cl.[4] ..... B01F 7/02

[52] U.S. Cl. ..... 366/298; 366/299; 366/300; 366/301; 366/312; 366/185

[58] Field of Search ..... 366/64, 66, 15, 96, 366/97, 84–86, 91, 291, 297–301, 219, 309, 240, 185, 312, 45, 46

[56] References Cited

U.S. PATENT DOCUMENTS

| | | | |
|---|---|---|---|
| 2,570,042 | 10/1951 | West | 366/300 X |
| 2,917,395 | 12/1959 | Csanyi | 366/301 X |
| 2,961,224 | 11/1960 | Wright | 366/297 |
| 3,638,920 | 2/1972 | Davis | 366/298 |
| 3,752,445 | 8/1973 | Nowak | 366/185 X |
| 3,790,138 | 2/1974 | Neier | 366/298 X |
| 3,901,482 | 8/1975 | Kieffaber | 366/85 |
| 4,337,583 | 7/1982 | Harris | 366/300 X |
| 4,506,990 | 3/1985 | Neier et al. | 366/300 X |
| 4,509,860 | 4/1985 | Lasar | 366/185 X |

*Primary Examiner*—Timothy F. Simone

*Attorney, Agent, or Firm*—Hovey, Williams, Timmons & Collins

[57] ABSTRACT

A conditioning device for an extruder includes two juxtaposed, frustocylindrical, intercommunicated chambers, one chamber of which has a greater cross sectional area than the other chamber. A mixing shaft centrally located within the small chamber carries a number of radially extending beaters which rotate at a speed twice that of the rotational speed of paddles mounted on a second mixing shaft located in the large chamber and material introduced into the vessel is passed from side-to-side between the two chambers while being advanced along the length of the vessel. The use of relatively fast moving beaters within a small mixing chamber in combination with relatively slow moving paddles in a larger mixing chamber enables flour-like materials to be properly blended with water with both sufficient agitation and proper retention times within the vessel. In an alternate embodiment of the invention, the vessel is tiltable about an axis parallel to the longitudinal axia thereof, in order to bias the materials under the influence of gravity toward one chamber or the other and to thereby vary the residence time of the materials within the vessel and the mixing characteristics of the device.

10 Claims, 1 Drawing Sheet

PRECONDITIONING APPARATUS FOR EXTRUDER

BACKGROUND OF THE INVENTION

1. Field of the Invention

This invention relates to an apparatus for preconditioning farinaceous materials such as soy-containing pet foods prior to treating the same in an extrusion cooker. More particularly, the invention is concerned with a selectively tiltable conditioning vessel having two juxtaposed, frustocylindrical chambers, and one of the chambers has a cross sectional area larger than the other chamber so that the food products are exposed to relatively high speed blending in the smaller chamber as well as relatively slow passage through the larger chamber to provide both sufficient agitation and adequate residence time of the materials in the vessel.

2. Description of the Prior Art

Preconditioners are widely used in combination with extruders for preparing and blending food materials before further processing and cooking of the same in an extruder. For example, products having a relatively high percentage of flour-like material are often blended with water and treated with steam in a conditioner prior to extrusion. Use of preconditioners is particularly advantageous in preparing products comprised of farinaceous material such as pet food containing a relatively large percentage of soy flour.

Conventional preconditioning apparatus often includes an elongated vessel having a pair of identical side-by-side, frustocylindrical, intercommunicated mixing chambers each presenting equal areas in transverse cross sections. Each chamber is provided with mixing bars or beaters radially mounted on the rotatable drive shaft aligned with the longitudinal axis of the chamber, and the beaters have a configuration for longitudinally advancing the product from an inlet end of the vessel toward an outlet end of the same as the materials are swept around the frustocylindrical walls. Also, the beaters of each chamber are configured to alternatively pass the product from one chamber to the other when the materials approach the intersection between the chambers.

A series of water inlets are often provided along at least a portion of the length of preconditioning vessels for adding water to the food materials during advancement of the latter longitudinally through the mixing chambers. Obviously, it is highly important that water introduced into preconditioning vessels becomes thoroughly and uniformly blended with materials having a flour-like consistency in order to avoid formation of lumps. Typically, lumps represent a non-homogeneous mixture of the material and water with the material forming the outer surface of the lump receiving the highest percentage of moisture.

Proper blending of water with materials having a flour-like consistency requires both proper residence time within the conditioning vessel as well as proper mixing or agitation of the materials with water. As such, increasing the rotational speed of the beaters of conventional preconditioners in an attempt to increase agitation within the vessel causes the materials to pass through the vessel at a greater speed which correspondingly reduces the residence time of the materials within the vessel to values that may be unacceptabble. On the other hand, reducing the rotational speed of the beaters to increase residence time within the vessel adversely affects the mixing characteristics of the vessel to the point where proper blending of the materials with water is not achieved. Increasing the overall length of the vessel is not desirable because of mechanical problems associated with the mixing shafts.

Moreover, the structural nature of conventional preconditioning apparatus does not lend itself to flexibility of operation where it is desired, for example, to use one apparatus for processing different materials at varying flow rates. That is, temporarily increasing the length of the apparatus with modular vessel sections in an attempt to increase residence time of materials within the vessel is not a satisfactory solution due to the inherent weight and structural characteristics of the apparatus as well as the predefined material inlets and outlets which are often located at specified positions to pass the materials from one processing stage to the next. As such, it would be desirable to provide a means for varying the residence time of materials passing through a preconditioning apparatus to enable the latter to process different types of materials at optionally varying flow rates.

SUMMARY OF THE INVENTION

The present invention avoids the above noted problems associated with conventional preconditioning apparatus by provision of a mixing vessel having two elongated, juxtaposed, intercommunicated frustocylindrical chambers wherein one of the chambers has a cross sectional area greater than the other chamber. As the materials advance longitudinally through the vessel and pass alternatively from one chamber to the other, beaters in the smaller chamber agitate the materials at a relatively high speed and paddles in the larger chamber mix and advance the products at relatively slower speeds to provide both sufficient mixing and adequate retention time for the materials in the vessel.

In preferred forms of the invention, the radius of curvature of the larger chamber is one and one-half times as great as the radius of curvature of the smaller chamber. Furthermore, means are included for rotating the beaters in the smaller chamber at twice the rotational speed of paddles located in the larger chamber in order to increase residence time of the materials in the larger chamber while improving mixing characteristics of the same in the smaller chamber.

In other forms of the invention, the vessel is selectively pivotal about an axis generally parallel to the longitudinal axis thereof. Residence time of the materials in the vessel can thus be increased by shifting the larger chamber downwardly relative to the smaller chamber so that the materials tend to fall under the influence of gravity toward the larger chamber and remain within the latter for a greater percentage of time. As a consequence, the preconditioning apparatus of the present invention is provided with great flexibility of operation to enable use of the same for treating a wide range of materials at different flow rates and residence times.

DETAILED DESCRIPTION OF THE DRAWING

Figure 1:
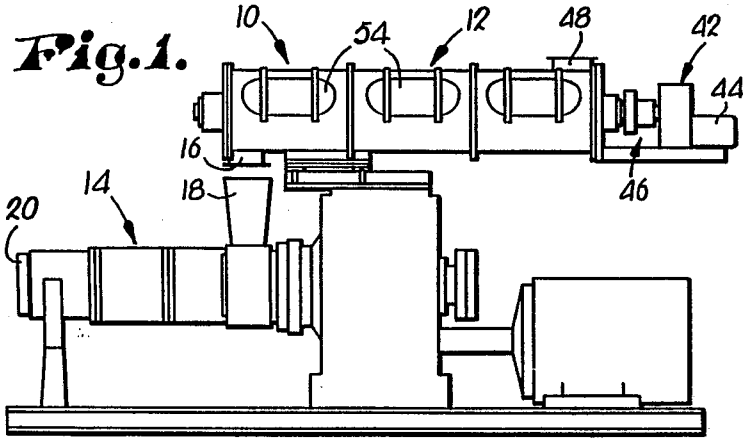
FIG. 1 is a side elevational view of the preconditioning apparatus or device of the present invention shown as being mounted atop an otherwise conventional extruder mechanism.

A conditioning device for mixing and hydrating flour or the like is shown in FIGS. 1–4 and is broadly designated by the numeral 10. The device 10 includes an elongated conditioning vessel 12 which is mounted atop an extruder 14 such that an outlet 16 of the conditioning vessel 12 is positioned directly above an inlet hopper 18 of the extruder 14, as illustrated in FIG. 1. A motor 18 drives the extruder 14 and the cooked food products are normally discharged through a die 20 positioned at the front of the extruder 14.

Figure 2:
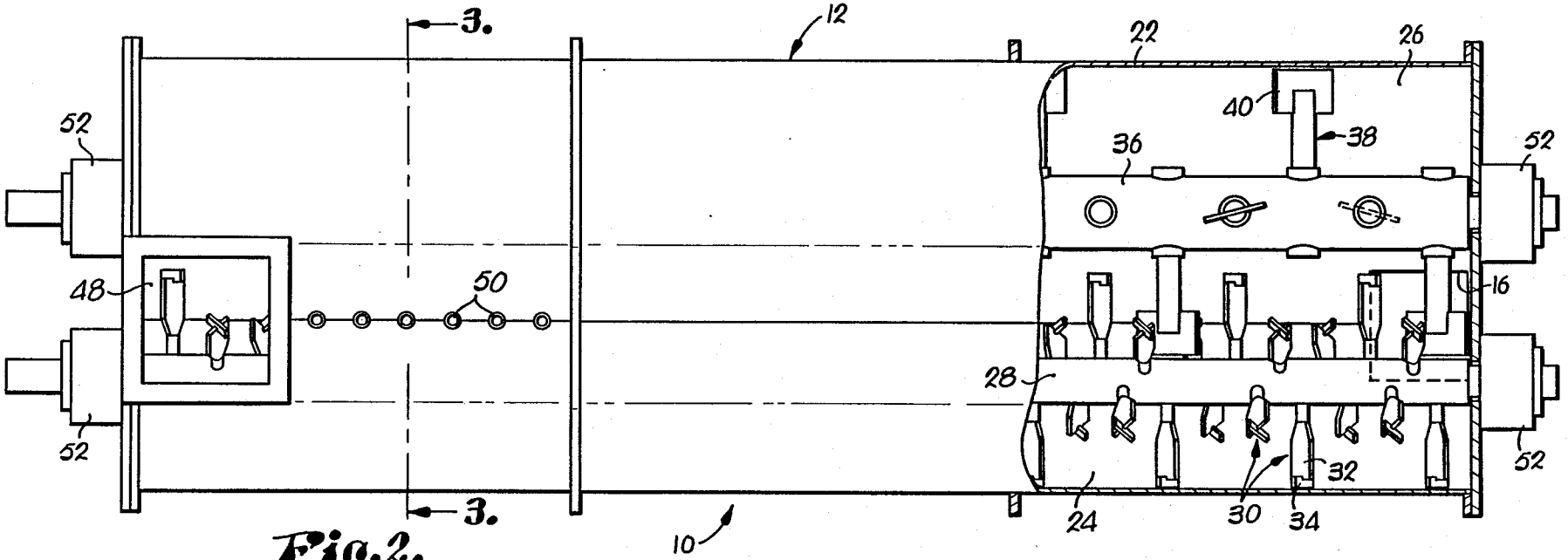
FIG. 2 is an enlarged plan view of the preconditioning device illustrated in FIG. 1 with a cover of the device broken in section to reveal two intercommunicated mixing chambers and a pair of elongated mixing shafts respectively located along the length of a corresponding chamber.
Figure 3:
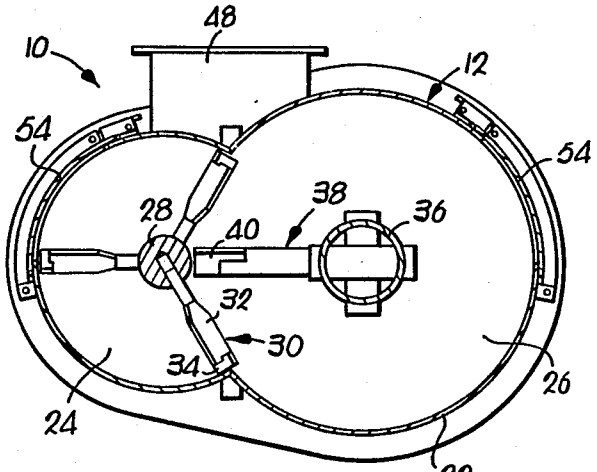
FIG. 3 is a side cross sectional view of the preconditioning device taken along line 3—3 of FIG. 2 and particularly illustrating a paddle and associated set of three beaters with downstream paddles and beaters not shown for clarity.

Referring now to FIGS. 2 and 3, the conditioning vessel 12 has elongated, transversely arcuate walls 22 presenting a first frustocylindrical mixing chamber 24 and a second frustocylindrical mixing chamber 26. The chambers 24, 26 are juxtaposed and intercommunicate with each other, and the second elongated mixing chamber 26 has a greater cross sectional area than the first elongated mixing chamber 24. Preferably, the radius of curvature of the large mixing chamber 26 is one and one-half times as great as the radius of curvature of the small mixing chamber 24.

A first elongated mixing shaft 28 is centered along the longitudinal axis of the first or small mixing chamber 24 and supports a plurality of mixing elements or beaters 30 which are secured to the first shaft 28 at spaced locations along the length of the latter and thus along the length of chamber 24. Each of the beaters 30 includes an elongated, relatively long flat element 32 inclined to advance materials longitudinally of the chamber 24 as shaft 28 is rotated. The outermost regions of each beater 30 which extend radially from mixing shaft 28 present a T-shaped configuration by means of a relatively short, flat head 34 that is fixed to the outer end of each respective element 32 in transverse relationship thereto.

A second elongated mixing shaft 36 is centrally located within the second or large mixing chamber 26 along the central axis thereof, and carries a plurality of mixing elements or paddles 38 that extend radially from the second mixing shaft 36 at spaced locations along the latter and thereby along the length of a large mixing chamber 26. Each paddle 38 includes a relatively large, flat mixing member 40 that is inclined in relation to the longitudinal axis of the second mixing shaft 36 in order to advance materials within vessel 12 in a direction along the length of the latter.

By comparing FIGS. 2 and 3, it can be appreciated that the beaters 30 located within small mixing chamber 24 are arranged in groups of three and the beaters 30 in any one group are spaced at 120° locations around the first mixing shaft 28 also spaced a distance apart in a direction along the length of the shaft 28. Each group of three beaters 30 is oriented 180° around shaft 28 relative to adjacent groups. On the other hand, adjacent paddles 38 are mounted 90° apart from each other in sequence around shaft 36 and also are spaced from each other in a direction longitudinally of shaft 36.

A drive means 42 operably coupled with the shafts 28, 36 for axial rotation thereof includes a motor 44 and gear reducing means 46, as is shown in FIG. 1. The drive means 42 includes structure for rotating the first mixing shaft 28 located within the small mixing chamber 24 at a greater rotational speed than the rotational speed of the second mixing shaft 36 located within large mixing chamber 26. Preferably, the first mixing shaft 28 is rotated at about twice the rotational speed of the second mixing shaft 36 so that the movement of beaters 30 is coordinated with motion of paddles 38. Viewing FIG. 3, mixing shaft 28 rotates in a counterclockwise direction while shaft 36 turns in an opposite, clockwise direction.

More particularly, and again with reference to FIGS. 2 and 3, each of the paddles 38 is aligned in association with one group of three of the beaters 30. When the paddle 38 is in the horizontal orientation shown in FIG. 3 extending in a direction toward mixing shaft 28 supporting beaters 30, one of the beaters 30 extends outwardly from the first shaft 28 in the same direction as the corresponding paddle 38 while the other two beaters associated with the same paddle 38 are proximally centered on either side of the paddle 38. Rotation of the first shaft 28 at twice the rotational speed of second shaft 36 causes the associated paddle 38 to repetitively mesh with the associated beaters 30 as depicted in FIGS. 2 and 3.

The walls 22 of vessel 12 include structure defining the material outlet 16 at one end of the vessel 12 as well as a material inlet 48 located at the opposite end of vessel 12. Moreover, a plurality of water and/or steam injection ports 50 are positioned along the length of the vessel 12 between inlet 48 and outlet 16 and optionally are located at the intersection between the chambers 24, 26 as shown in FIG. 3. The walls 22 of vessel 12 support bearings 52 carrying the shafts 28, 36. Additionally, doors 54, as illustrated in FIGS. 1 and 3, are located along the length of each of the chambers 24, 26 for access to interior regions of the same as may be necessary for cleaning and maintenance.

During operation of the device 10, food products or material introduced through inlet 48 is received within vessel 12 and immediately thereafter is subjected to the influence of beaters 30 and paddles 38. More specifically, the inclination of element 32 and member 40 of beaters 30 and paddles 38 respectively causes the material to be advanced in a direction along the length of the elongated vessel 12; however, the material also shifts laterally and alternates between positions within chamber 24 and chamber 26 during longitudinal movement through vessel 12 whenever the material is in a position adjacent the intersection of chambers 24, 26. As can be appreciated by reference to FIGS. 2 and 3, the overlapping nature of the paddles 38 and beaters 30 with each other cause the material to pass from chamber 24 to chamber 26 and subsequently back to chamber 24 in correspondence to the speed of rotation of shafts 28, 36.

Rotation of the beaters 30 at a speed which is approximately twice the rotation of the paddles 38 causes the material within the small mixing chamber 24 to be subjected to relatively high agitation and mixing. However, as the same material approaches the intersection between chambers 24, 26, the associated paddle 38 sweeps a portion of the material into the large mixing chambers 26, and the relatively slow rotational speed of the paddle 38 immediately decreases the agitation of the material. The relatively large area of mixing chamber 26, in cooperation with the relatively slow rotational speed of the paddles 38, causes the material to experience a relatively large residence time within large mixing chamber 26 before returning again to the small mixing chamber 24. As a consequence, the small chamber 24 provides proper, relatively high speed blending of water injected through ports 50 and material within the small mixing chamber 24, while the paddles 38 provide sufficient residence time for the material within vessel 12 so that the same is not advanced through the device 10 at an unacceptably high rate of speed that would not afford sufficient time for proper blending of the materials.

Figure 4:
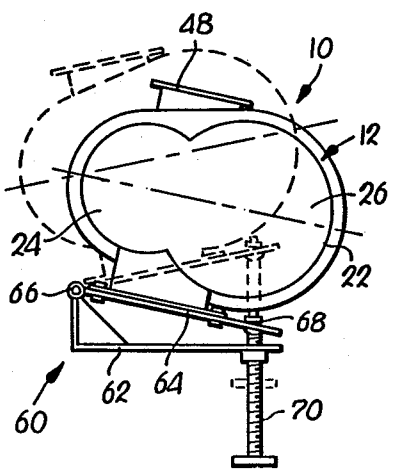
FIG. 4 is a schematic, illustrative mechanism of an alternate embodiment of the invention depicting a means for tilting the preconditioning device shown in FIGS. 1–3 in order to increase or decrease residence time of materials passing through the same.

An alternative embodiment of the present invention is schematically illustrated in FIG. 4, wherein the device 10 is provided with a means 60 operably coupled with the vessel 12 for selective pivotal movement of the latter about an axis generally parallel to the longitudinal axis thereof. It is to be understood, however, that the structural details shown in FIG. 4 are for illustrative purposes only, and other mechanisms for tilting the vessel 12 can readily be devised.

More particularly, the means 60 for pivoting vessel 12 includes a bracket 62 that is fixed to a stationary support such as the top of the extruder 14 shown in FIG. 1. The bracket 62 is hingedly coupled to a support 64 by means of pivot 66, and the vessel 12 is mounted atop support 64 for movement with the latter as support 64 swings in an arc about pivot 66. The support 64 is carried in one region by a nut 68 that receives threads of a complementally configured adjusting screw 70, such that selective rotation of the adjusting screw 70 causes support 64 to swing about pivot 66 and thus tilt vessel 12 about an axis parallel to its longitudinal axis.

The means 60 for selectively tilting the vessel 12 enables the operator to readily vary the residence time of materials passing through device 10. For example, when the adjusting screw 70 is in the full line position shown in FIG. 4, and the center of the large mixing chamber 26 is somewhat below the center of the small mixing chamber 24, materials within the vessel 12 will tend to fall under the influence of gravity toward the large chamber 26 and thereby reside in the same for longer periods of time than would otherwise be possible, such that the overall residence time of material passing through the vessel 12 is increased. On the other hand, if the adjusting screw 70 is positioned in the dashed line orientation shown in FIG. 4 to cause the vessel 12 to assume the corresponding dashed line orientation, materials within device 10 will tend to more readily fall toward the first or small mixing chamber 24 and therebvy be moved through the vessel 12 at a somewhat greater speed due to the fact that the rotational speed of first mixing shaft 28 is greater than the rotational speed of second mixing shaft 36. It can be appreciated that tilting of vessel 12 about pivot 66 not only changes residence time of materials within chambers 24, 26 but also enables the user to vary the proportion of time the materials are exposed to the relatively high speed beaters 30 in comparison to the percentage of time the materials are exposed to the paddles 38, so that the blending characteristics of the device 10 can be changed as may be desired, for example, when different types of materials are conditioned by device 10.

I claim:

1. A device for conditioning material such as flour or the like, comprising:

a conditioning vessel having elongated, transversely arcuate walls presenting a pair of elongated, juxtaposed, intercommunicated chambers, one of said chamber having a greater cross-sectional area than the other of said chambers;

structure defining a material inlet and a material outlet in spaced relationship to each other along the length of said vessel and in communication with said chambers;

a pair of elongated mixing shafts each having a plurality of outwardly extending mixing elements secured thereto;

means rotationally mounting each of said shafts within and generally along the length of a corresponding chamber; and drive means operably coupled with said shafts for axial rotation thereof to effect conditioning of material continuously passing through said vessel, said drive means including structure for rotating said shafts at different rotational speeds respectively, the mixing elements of each shaft being oriented for intercalation with the mixing elements of the other shaft upon rotation of the shafts, and for continuous net flow of said material from said inlet towards and out said outlet during said shaft rotation.

2. The device as set forth in claim 1, said chambers each presenting a frustocylindrical cross-sectional configuration having respective radii of curvature, the one of said radii corresponding to the one of said chambers having the greater cross-sectional area being one-and-one-half times as great as the other said radius.

3. The device as set forth in claim 1, said device further including means operably coupled with said vessel for selective pivotal movement of said vessel about an axis generally parallel to the longitudinal axis thereof.

4. The device as set forth in claim 1, wherein the one of said shafts being situated in the smaller of said chambers being rotated at about twice the rotational speed of the other of said shafts.

5. The device of claim 1, said inlet and outlet being located respectively adjacent the opposed ends of said vessel.

6. The device of claim 1, including means for injection of water into said vessel through the side walls thereof.

7. The device of claim 1, said mixing elements each comprising an elongated beater substantially radially oriented relative to a corresponding shaft.

8. The device of claim 1, the mixing elements within the larger of said chambers being oriented for passing in close relationship to the mixing shaft within the smaller of said chambers, during rotation of said shafts.

9. The device of claim 1, including structure for rotation of said shafts in different rotational directions respectively.

10. The device of claim 9, the shaft situated within the smaller of said chambers rotating in a counterclockwise direction, with the shaft situated within the larger of said chambers rotating in a clockwise direction.

* * * * *